US009925471B2

(12) United States Patent
Flores

(10) Patent No.: US 9,925,471 B2
(45) Date of Patent: Mar. 27, 2018

(54) TOY WITH ROTATION MECHANISM

(71) Applicant: KIDS II, INC., Atlanta, GA (US)

(72) Inventor: Milton Aaron Flores, Atlanta, GA (US)

(73) Assignee: KIDS II, INC., Atlanta, GA (US)

( * ) Notice: Subject to any disclaimer, the term of this patent is extended or adjusted under 35 U.S.C. 154(b) by 65 days.

(21) Appl. No.: 14/483,991

(22) Filed: Sep. 11, 2014

(65) Prior Publication Data

US 2015/0079875 A1 Mar. 19, 2015

Related U.S. Application Data

(60) Provisional application No. 61/879,336, filed on Sep. 18, 2013.

(51) Int. Cl.

| | |
|---|---|
| ***A63H 29/08*** | (2006.01) |
| ***A63H 18/00*** | (2006.01) |
| ***A63F 7/36*** | (2006.01) |
| *A63F 7/28* | (2006.01) |
| *A63F 7/24* | (2006.01) |
| *A63F 7/34* | (2006.01) |
| *A63F 9/24* | (2006.01) |

(52) U.S. Cl.

CPC ..... *A63H 18/00* (2013.01); *A63F 7/3622* (2013.01); *A63F 7/249* (2013.01); *A63F 7/28* (2013.01); *A63F 2007/345* (2013.01); *A63F 2009/247* (2013.01); *A63F 2009/2482* (2013.01)

(58) Field of Classification Search

CPC ..... F41B 11/54; F41B 11/52; A63F 7/3622
See application file for complete search history.

(56) References Cited

U.S. PATENT DOCUMENTS

| | | | | |
|---|---|---|---|---|
| 1,260,664 A | | 3/1918 | Gregory | |
| 1,492,105 A | * | 4/1924 | Reynolds | G09F 19/10 40/406 |
| 3,251,155 A | * | 5/1966 | Bjork | A63F 7/3622 273/120 R |
| 3,570,171 A | * | 3/1971 | Shook | A63H 29/08 446/173 |
| 3,782,729 A | * | 1/1974 | Ernst | A63F 7/3622 273/138.2 |
| 3,818,628 A | * | 6/1974 | Ensmann | A63F 7/00 273/342 |
| 4,128,964 A | | 12/1978 | Ogasawara | |
| D289,666 S | * | 5/1987 | Udagawa | D21/564 |
| 4,790,531 A | * | 12/1988 | Matsui | F25C 3/04 238/10 R |
| D302,032 S | * | 7/1989 | Kamikawa | D21/564 |

(Continued)

*Primary Examiner* — John E Simms, Jr.
*Assistant Examiner* — Urszula M Cegielnik
(74) *Attorney, Agent, or Firm* — Gardner Groff Greenwald & Villanueva, PC

(57) ABSTRACT

A toy includes a rotational lift mechanism having a rotatable drive shaft, a helical guide track positioned about the drive shaft, a receiver basin positioned atop the drive shaft, an upper track, a tilted panel, a chute having an opening formed therein and a lower track. In example forms, one or more balls traverse a closed-loop pre-defined path including along the guide track and within the basin, along the upper track, through an airborne trajectory into contact with the tilted panel, bouncing into the opening of the chute, and back along the lower track.

22 Claims, 7 Drawing Sheets

(56) References Cited

U.S. PATENT DOCUMENTS 4,844,447 A * 7/1989 McKnight ..... A63F 7/02 273/121 B
D305,556 S * 1/1990 Lo ..... D21/564
5,039,109 A * 8/1991 Mahoney ..... A63B 69/0097 248/647
5,044,639 A * 9/1991 Egging ..... A63F 9/02 273/342
5,279,871 A * 1/1994 Segan ..... A63H 18/04 428/18
5,312,285 A * 5/1994 Rieber ..... A63F 7/3622 273/109
5,437,408 A * 8/1995 Chesnut ..... A45C 1/12 194/344
5,542,570 A * 8/1996 Nottingham ..... G07F 11/44 221/192
5,709,581 A 1/1998 Rothbarth et al.
5,735,724 A 4/1998 Udagawa
5,785,573 A 7/1998 Rothbarth et al.
5,855,501 A * 1/1999 Kato ..... A63F 7/3622 446/168
5,908,343 A 6/1999 Rothbarth et al.
5,954,042 A * 9/1999 Harvey ..... F41B 11/53 124/48
6,074,269 A * 6/2000 Rothbarth ..... A63F 7/3622 238/10 R
6,415,781 B1 * 7/2002 Perrone ..... F41B 11/53 124/49
6,733,403 B2 * 5/2004 Courtright ..... A63B 63/083 473/431
6,978,776 B2 * 12/2005 Hamilton ..... F41A 9/77 124/48
7,524,246 B2 4/2009 Briggs et al.
8,381,710 B2 * 2/2013 Nguyen ..... F41B 11/53 124/51.1
8,814,628 B2 * 8/2014 O'Connor ..... A63H 18/02 446/435
2004/0075571 A1 * 4/2004 Fong ..... H01H 35/025 340/689
2007/0012304 A1 * 1/2007 van Dorsser ..... F41B 11/53 124/51.1
2007/0209543 A1 * 9/2007 Beaulieu ..... A63F 7/3622 104/53
2007/0256676 A1 * 11/2007 Orvis ..... F41B 11/50 124/31
2008/0236558 A1 * 10/2008 Bosch ..... F41B 11/53 124/48
2014/0017970 A1 * 1/2014 Comfort ..... A63H 18/02 446/168

* cited by examiner

TOY WITH ROTATION MECHANISM

CROSS-REFERENCE TO RELATED APPLICATIONS

This application claims the benefit of U.S. Provisional Patent Application Ser. No. 61/879,336 filed Sep. 18, 2013, the entirety of which is hereby incorporated herein by reference for all purposes.

TECHNICAL FIELD

The present invention relates generally to the field of toys and games, and more particularly to a children's toy having objects movable along a continuous path.

BACKGROUND

Infant and children's toys are known and are continuously improved upon and reconfigured to provide greater interest and entertainment. Some toys are known to include electronics or moving components which allow for children to visually see changes or behaviors in the toy. Other toys include components that can be manipulated or physically moved to provide interest and entertainment. Continued improvements to toys including electronics and/or moving and/or manipulative components is sought. It is to the provision of a toy with a rotation mechanism that the present invention is primarily directed.

SUMMARY

In example embodiments, the present invention provides a toy with a rotation mechanism. In example forms, a motor and a battery supply are provided for providing rotation to a drive shaft of the rotation mechanism.

In one aspect, the present invention relates to a toy including a base, a rotation mechanism, an upper track, a tilted panel, a chute, and a lower track. The rotation mechanism includes a rotatable drive shaft, a guide track extending around the drive shaft, and a basin positioned atop the drive shaft. The drive shaft is generally positioned transverse relative to the base and includes at least one paddle. A portion of the drive shaft extends into or through the basin and includes an arm transversely extending therefrom. The upper track includes a first end and a second end, wherein the first end is coupled to a portion of the basin and a second end includes a ramp. The tilted panel is positioned on a portion of the base generally below the ramp of the upper track. The chute includes an opening. And, the lower track extends from within the opening of the chute to a lower base portion of the drive shaft. In example forms, at least one object is capable of rolling, sliding or otherwise moving along a predetermined path from the lower base portion of the rotation mechanism, along the guide track up and into the basin, along the upper track and off of the ramp, through the air, into contact with the tilted panel and into the air again and through the opening of the chute, and along the lower track back to the lower base portion of the rotation mechanism.

In example forms, the base includes a motor for driving the drive shaft, a battery or other power supply, and a circuit board. Optionally, a speaker is provided for emitting audible sounds, and/or lighting or display features are provided. Optionally, a spring biased shutter is movably mounted to the basin. The tilted panel generally includes an inclination angle between about 15-45 degrees. The upper track is generally downwardly sloped from the basin to the ramp and the lower track is generally downwardly sloped from the chute to the lower base portion of the drive shaft. In example forms, the object that is capable of moving along the predetermined path is a ball. The ball is generally about 1.97 inches in diameter. Optionally, one or more of the paddles of the drive shaft include a spacer tab for preventing two or more objects from being captured between two of the paddles.

In another aspect, the invention relates to a toy including a base, a rotation mechanism, an upper track, a tilted panel, a chute, and a lower track. The rotation mechanism is formed to resemble a tree and includes a rotatable drive shaft, a guide track extending around the drive shaft, and a basin positioned atop the drive shaft. The drive shaft is generally positioned generally vertically or transverse relative to the horizontal base, for example resembling the trunk of a tree, and includes at least one paddle or flange. A portion of the drive shaft extends through the basin and includes an arm transversely extending therefrom. The upper track is formed to resemble lush vegetation such as a tree canopy and includes a first end and a second end, wherein the first end is coupled to a portion of the basin and a second end includes a ramp. The tilted panel is positioned on a portion of the base generally below the ramp of the upper track. The chute is formed to resemble an animal and includes an opening, for example resembling the mouth of the animal. And, the lower track is formed to resemble a stream and extends from within the opening of the chute to a lower base portion of the drive shaft. In example forms, at least one object is capable of moving along a predetermined path from the lower base portion of the rotation mechanism, along the guide track up to within the basin, along the upper track and off of the ramp, into contact with the tilted panel and into the opening of the chute, and along the lower track back to the lower base portion of the rotation mechanism.

In another aspect, the invention relates to a toy including a ball, a lift mechanism comprising a flanged shaft and a helical track extending generally coaxial with the flanged shaft, wherein relative rotational motion between the flanged shaft and the helical track raises the ball from a lower inlet to an upper outlet. The toy preferably further includes an upper track for rolling the ball downwardly along a slope from the upper outlet of the lift mechanism to a ramp from which the ball falls along a first airborne trajectory, and an inclined contact surface generally below the ramp along the trajectory, which the ball impacts and bounces along a second airborne trajectory into a chute. The toy preferably further includes a lower track for rolling the ball from the chute to the lower inlet of the lift mechanism.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

Figure 1:
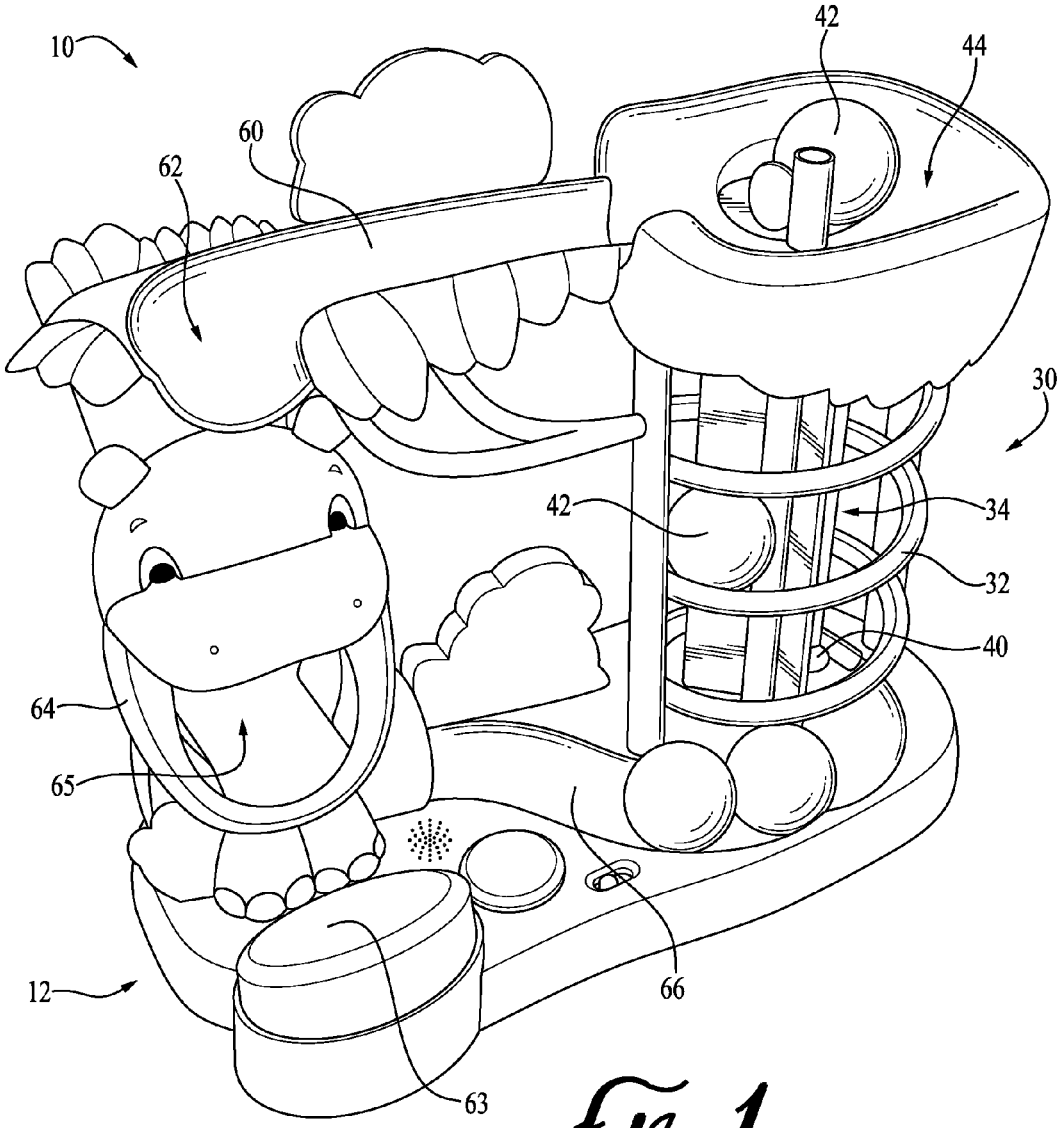
FIG. 1 is a perspective view of a toy with a rotation mechanism according to an example embodiment of the present invention.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-8 show a toy 10 comprising a rotational mechanism 30 according to an example embodiment of the present invention. In general, the toy 10 preferably provides for driving objects, such as toy balls 42, along a path. According to one example form, the toy balls 42 are driven by an actuator in the form of a generally vertical drive shaft 34 upward along a helical guide track 32 from a lower elevated position to a higher elevated position, which may be considered for example to be configured similar to an Archimedes' screw. The balls 42 can be manually placed on to the guide track 32 by a user, or can be mechanically moved on to the guide track, such as, for example, by a conveyor belt, spring-loaded ball-pushing device, etc. An upper receiver or basin 44 is preferably provided at the higher elevated position to contain the balls 42 that are driven along the guide track 32, and due to rotation of the drive shaft 34, an arm portion 56 thereof, which is exposed within the basin 44, eventually moves the balls 42 from the basin to travel along a pre-defined path.

In the depicted embodiment, the balls 42 are moved from the basin 44 along a downwardly sloping upper track 60 until being redirected by a downwardly sloping discharge or launching ramp 62. Optionally, the ramp 62 is generally perpendicular to the track 60, to slow or briefly stop the motion of balls 42 at the corner formed where the track feeds into the ramp, for more consistent control of the velocity of the ball as it exits the ramp, and thereby providing a more consistent trajectory of the balls. The balls 42 then fall off of the ramp 62, and due to gravity fall through the air along a predetermined first trajectory (for example, based on factors including the slope and configuration of the track 60 and ramp 62, the discharge velocity from the arm 56 of the drive shaft 34, and the elevation of the ramp 62), into contact with a tilted panel 63 and bounce or ricochet therefrom along a second trajectory into an opening 65 of a chute 64. The balls 42 then move along a lower track 66 back to the lower portion of the rotation mechanism 30. Preferably, the process then begins again, with the balls 42 moving along a closed-loop pre-defined path, which can be continuous as long as the drive shaft 34 of the rotation mechanism 30 operates to provide movement of the balls from the lower portion of the rotation mechanism 30 to the higher-elevated basin 44.

Figure 2:
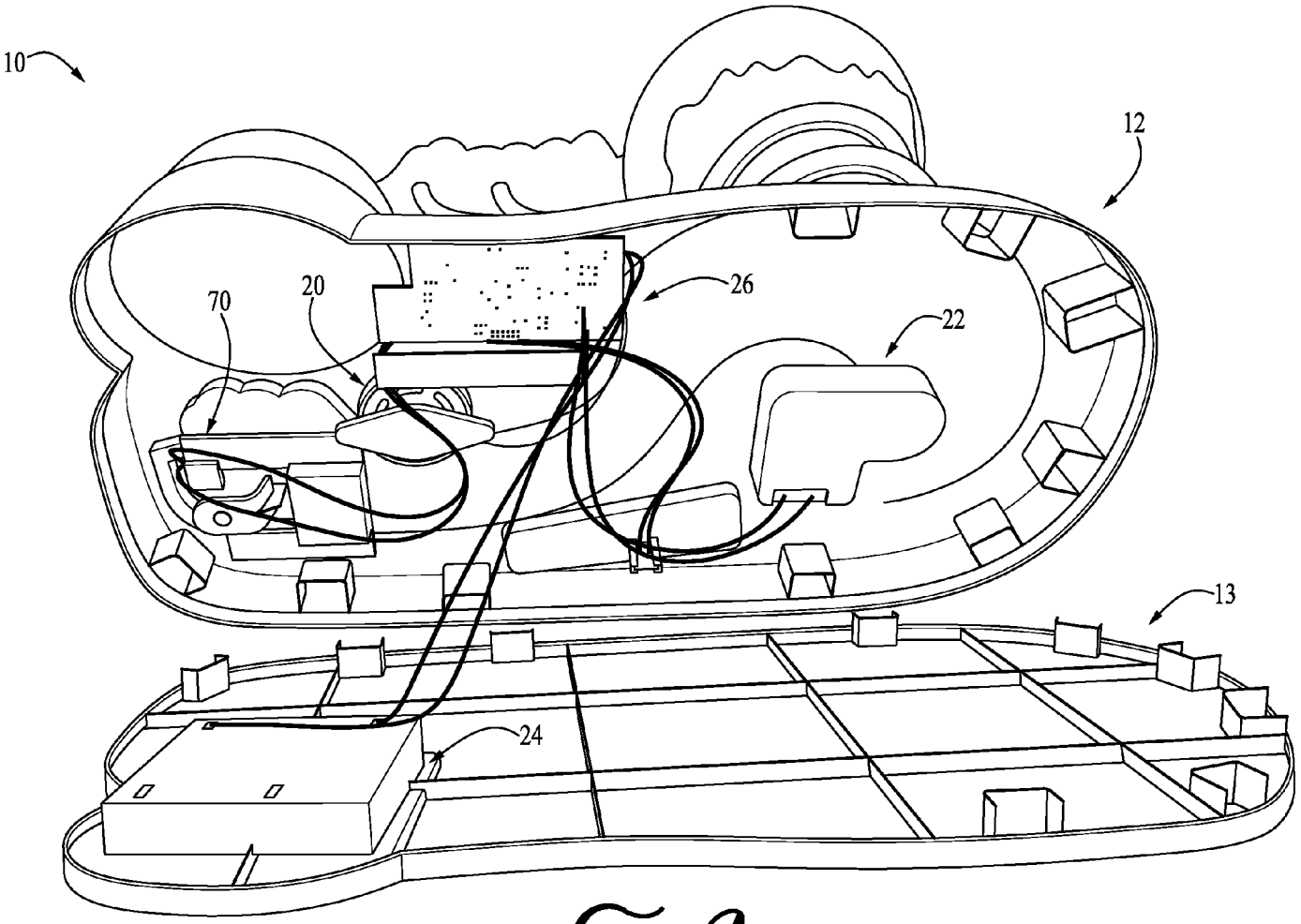
FIG. 2 is a bottom perspective view of the base of the toy of FIG. 1, wherein the bottom cover is removed therefrom and showing a plurality of components stored within the base.

As depicted in FIGS. 1-2, the toy 10 is generally supported by a generally horizontal base 12. In example forms, the base 12 further comprises a plurality of components to provide movement and interactive entertainment to the toy 10, which are generally concealed from visibility by a bottom cover 13. For example, a motor 22, a battery pack 24 or other power source, and a circuit board 26 or other electronic control means can be contained within the base 12, a speaker 20 may be optionally provided to emit audible sounds, and/or lights or displays may be provided for visual interaction. The motor 22 provides rotational movement to the drive shaft 34 and the battery pack 24 provides power to the motor 22, circuit board 26 and the speaker 20 and other accessories. In alternate embodiments, the drive shaft 34 is manually actuated, for example by a hand crank, spring-wound drive, or otherwise powered.

Figure 3:
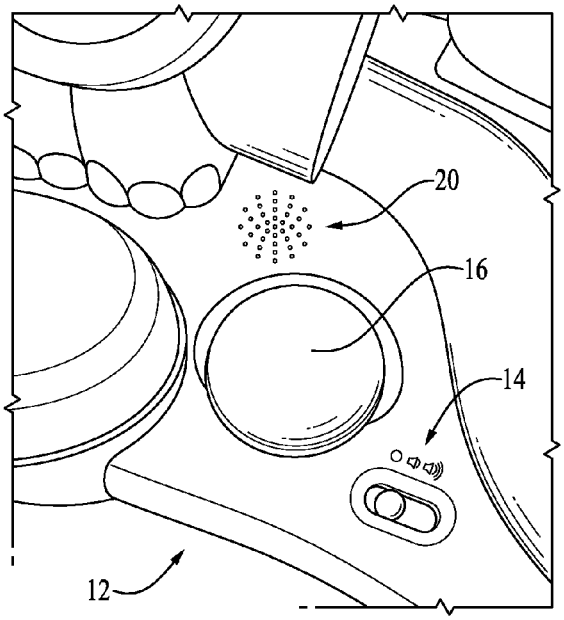
FIG. 3 is a perspective view of the toy of FIG. 1, showing components of the base.

FIG. 3 shows a switch 14, activation button 16, and openings for permitting the sounds of the speaker 20 to pass therethrough. In example forms, the switch 14, activation button 16 and speaker 20 are connected to the circuit board 26. The switch 14 provides for switching the toy between an "off" mode and an "on" mode, and the activation button 16 provides for initiating rotation of the drive shaft 34 when the switch 14 is in the "on" position. Optionally, the switch 14 may be configured to have two "on" modes, for example, an "on" mode wherein soft (or no) audible sounds are emitted and an "on" mode where louder audible sounds are emitted, different speeds of operation, or otherwise allowing the user to switch between various other different modes of operation. The activation button 16 optionally comprises a light therein such that actuation thereof causes the button to illuminate or cycle through a lighting sequence.

Figure 4:
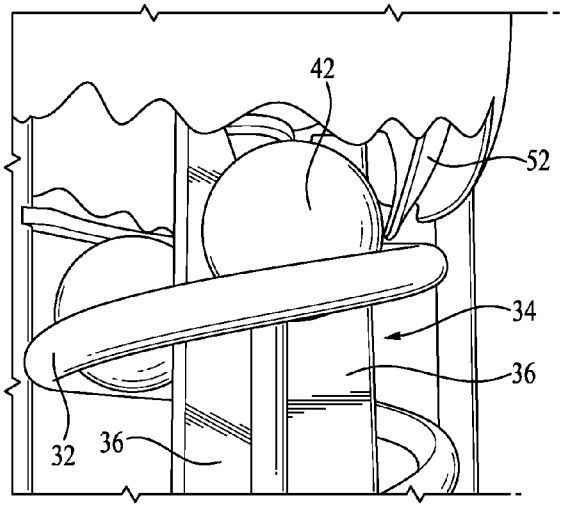
FIG. 4 is a close-up perspective view of a portion of the toy of FIG. 1, showing the rotation mechanism in greater detail.
Figure 5:
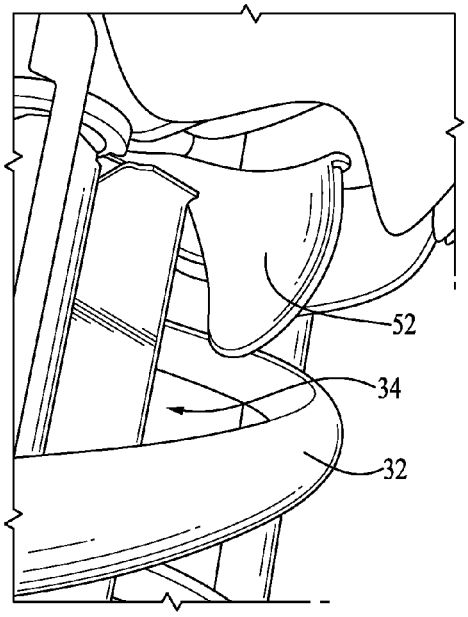
FIG. 5 is a detailed view of a portion of the rotation mechanism of FIG. 4, showing a shutter arm in greater detail.

As depicted in FIGS. 4-5, the drive shaft 34 of the rotation mechanism 30 comprises a plurality of transverse flanges or paddles 36 to engage the ball 42 that is positioned on the guide track 32 and to propel the ball 42 along an upward, helical path around the guide track. Preferably, the ball 42 is spherical and is sized to generally rest atop a portion of the guide track 32 while being held between at least two paddles 36. In example form, the helical guide track 32 is positioned concentrically relative to the drive shaft 34 (providing uniform spacing around the drive shaft 34 corresponding to the ball diameter) and the "threads" or portions of the guide track 32 are generally spaced apart by about 1¾". In example forms, the balls 42 are between about 1.5-2.5 inches in diameter, more preferably at least about 1.97 or 2 inches in diameter, so as not to be a choking hazard for infants or children. Furthermore, the balls 42 and the pitch of the guide track 32 are correspondingly sized to prevent removal of a ball 42 from inside of the guide track 32 when the ball 42 is contained on the guide track 32 and between at least two paddles 36.

In example form, the drive shaft 34 comprises three paddles 36 that extend transversely outward from a central shaft or connecting web, extending generally parallel to one another along the vertical length of the drive shaft 34, spaced about 120° from one another, defining an equilateral triangular Y-shaped cross section when viewed from above. Alternatively, the drive shaft 34 can comprise more or fewer than three paddles, for example, generally planar (e.g., two paddles), X-shaped (e.g., four paddles), etc. In alternative embodiments, the balls 42 can be propelled along the guide track 32 by tabs, walls, or other guiding means located on the rotating shaft 34, the guide track 32, or another mechanism for moving the balls along the track. In still further alternate forms, the shaft 34 is fixed and the guide track 32 is rotationally driven to raise the balls 42. Preferably, as depicted in FIG. 1, the lower portion of each paddle 36 comprises at least one spacer tab 40 to prevent more than one ball 42 from being captured between two of the paddles 36, which could cause the toy to jam or prevent the drive shaft 34 from rotating.

A spring biased shutter or door 50 is preferably provided adjacent the top of the drive shaft 34 to selectively open and close an opening in the basin 44 so that the balls 42 traveling along the guide track 32 can enter the basin 44. Preferably, the shutter acts as a trap door to prevent access to the drive shaft 34 and prevent a user's fingers from being pinched between moving parts. As shown in FIGS. 4-5, the shutter 50 comprises a downwardly projecting arm or tongue 52 that is positioned near an upper portion of the guide track 32 to be engaged and actuated by the ball 42 (driven by the paddles 36) such that the shutter 50 is opened and the ball 42 can be ejected out of the guide track 32 and onto the basin 44. In example forms, the trap-door arm 52 generally extends transversely relative to the shutter 50, with an inclined or arcuate contact face for interaction with the ball 42, and a rotational coupling with an axle at the top of the drive shaft 34, which is spring biased to retain the trap door or shutter 50 closed unless a ball 42 is being lifted therethrough.

Figure 6A:
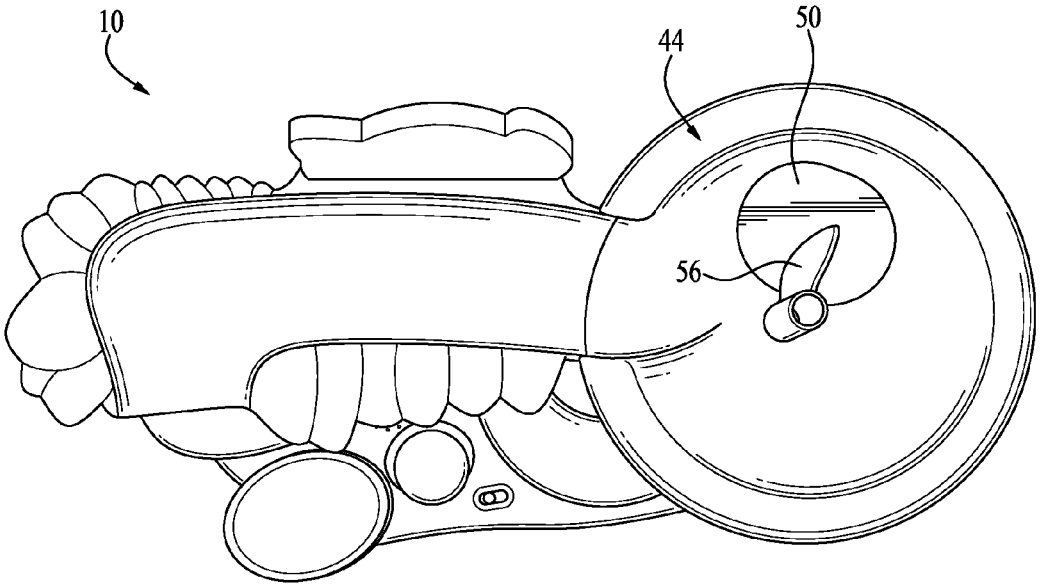
FIG. 6A is a top view of the toy of FIG. 1, showing the shutter in a closed position.
Figure 6B:
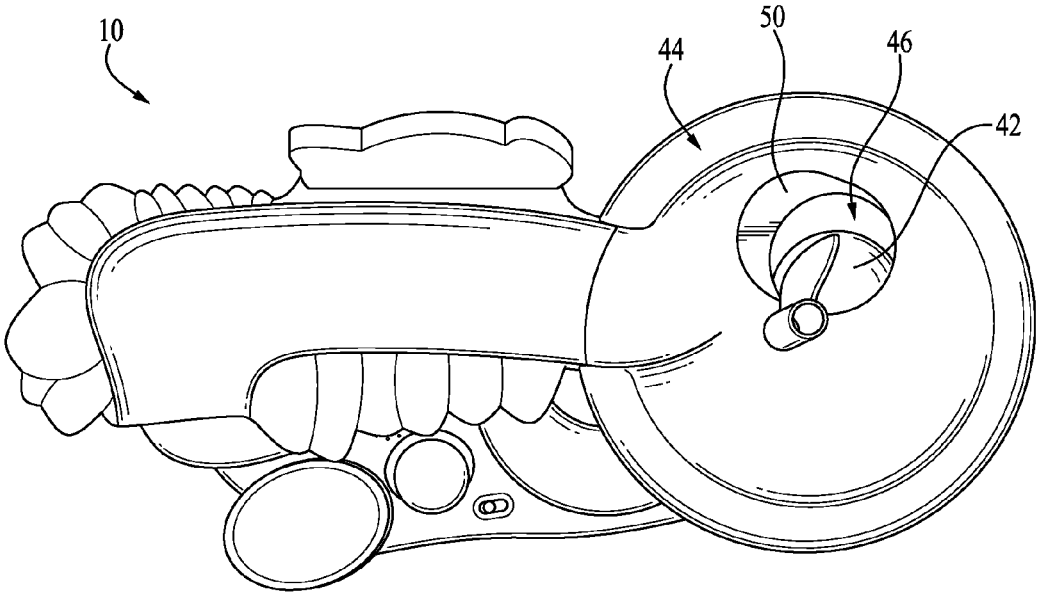
FIG. 6B is a top view of the toy of FIG. 6A, showing the shutter in a partially open position to provide for passage of a ball therethrough.
Figure 6C:
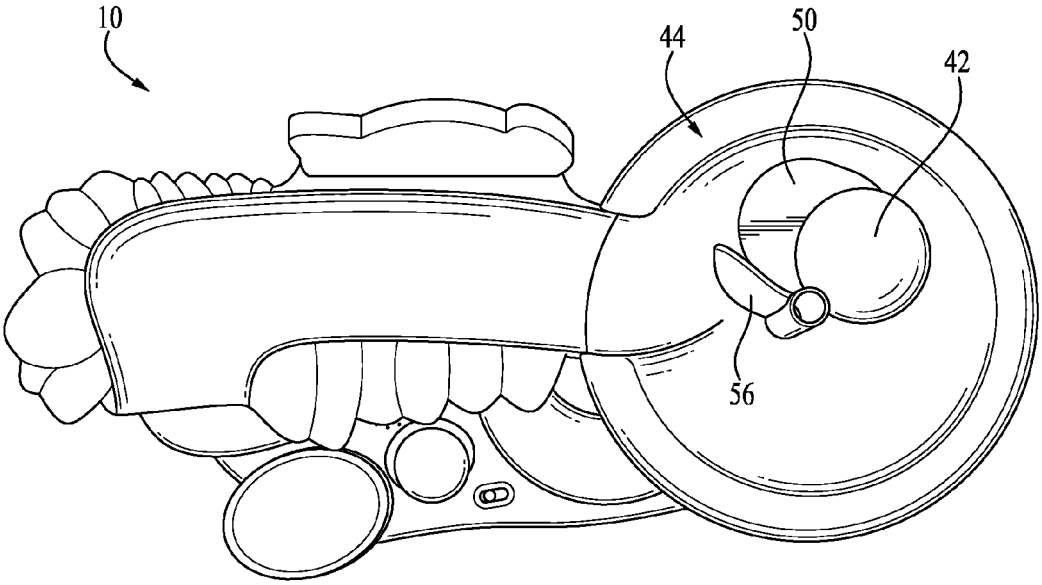
FIG. 6C is a top view of the toy of FIG. 6A, showing the shutter in a closed position and a ball resting within the basin.
Figure 6D:
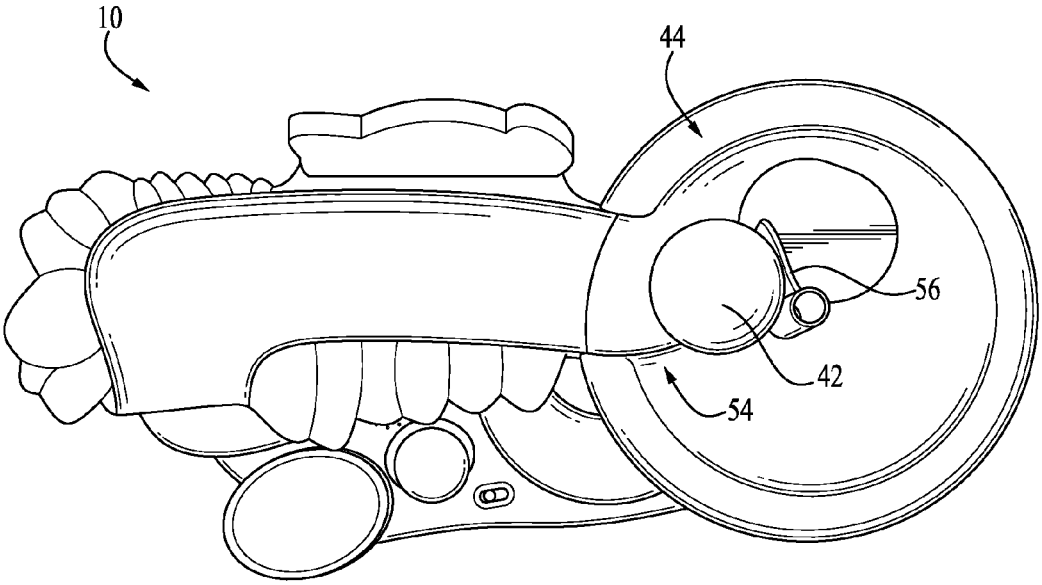
FIG. 6D is a top view of the toy of FIG. 6A, showing an arm of the drive shaft in contact with the ball that is contained within the basin.
Figure 6E:
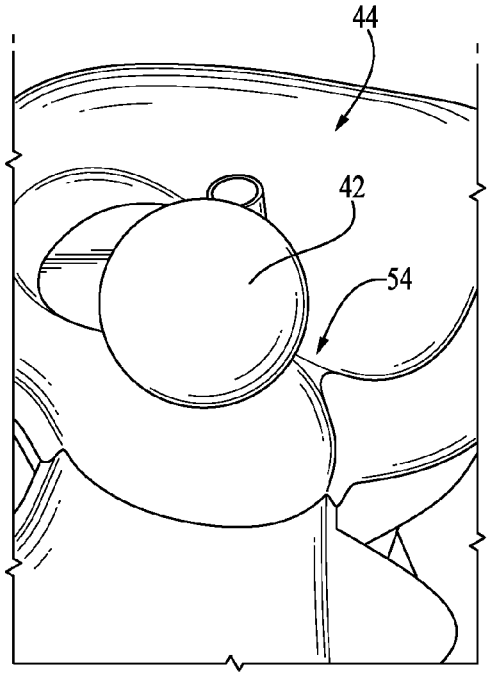
FIG. 6E is a detailed perspective view of the basin of FIG. 6D, showing the ball contained within a portion of the basin that is guided by a ridge thereof.
Figure 6F:
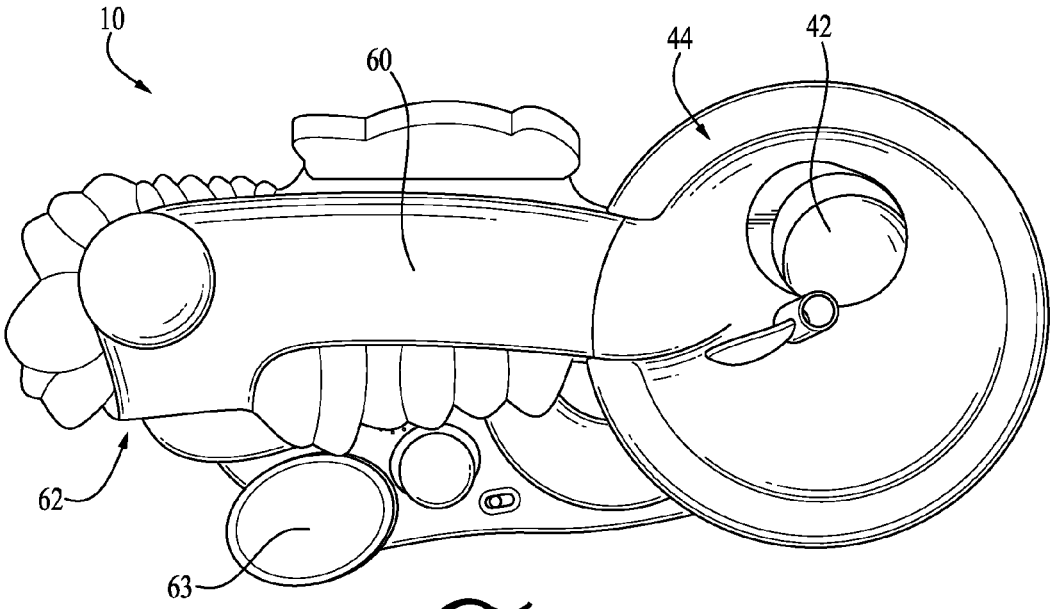
FIG. 6F is a top view of the toy of FIG. 6A, showing a ball proximal a ramp portion of an upper track and showing the shutter in the open position for passage of another ball to pass therethrough.
Figure 8:
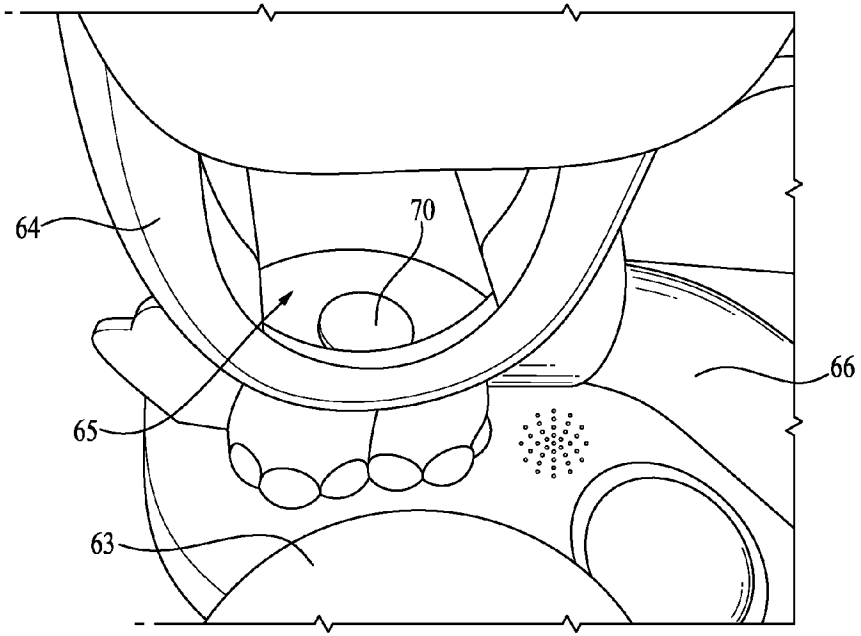
FIG. 8 is a front perspective view of the toy of FIG. 7, showing a tilted panel, an opening proximal a lower track thereof, and an indication button.
Figure 7:
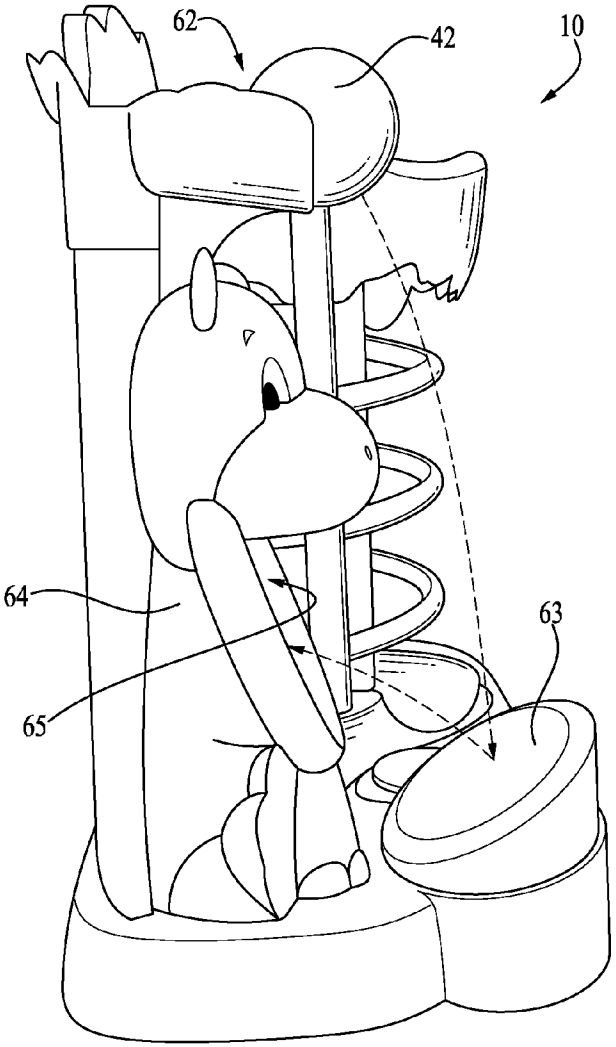
FIG. 7 is a side view of the toy of FIG. 6F, showing the ball resting on the precipice of the ramp and showing the trajectory or path of the ball after leaving the ramp.

FIGS. 6A-8 show a sequence of operation of a portion of the toy 10 according to an example embodiment of the present invention. As depicted in FIG. 6A, the shutter 50 is in the closed position while the balls 42 (unshown) are being lifted along the guide track 32. When a ball 42 reaches an upper portion of the guide track 32, for example, near the position as shown in FIG. 4, the ball 42 contacts the arm 52 and causes actuation to open the shutter 50. As shown in FIG. 6B, the shutter 50 is substantially open such that an opening 46 is defined within a portion of the basin 44. Continuing rotation of the drive shaft 34 causes the paddles 36 to force the ball 42 through the opening 46 and the shutter 50 is then spring-biased closed (see FIG. 6C). With the ball 42 now positioned within the basin 44, and with the drive shaft 34 continuing to rotate (counterclockwise when viewed from above, as in the example of FIGS. 6A-6F), the rotating arm 56 coupled to an upper portion of the drive shaft 34 contacts the ball 42 and begins to push the ball 42 towards the upper track 60 (see FIG. 6D). As depicted in FIG. 6E, the basin 44 preferably comprises a generally radially extending ridge 54 formed along a portion thereof to provide for guiding and directing the ball 42 towards the upper track 60. Preferably, the ridge 54 prevents the ball 42 from being trapped within the basin 44, for example, such that rotation of the arm 56 does not continuously push the ball 42 in a circular path around the basin 44. As the arm 56 continues to rotate, the ball 42 is pushed to move onto the upper track 60, and rolls down the downward sloping upper track 60 until being redirected around a corner onto the ramp 62 (see FIG. 6F). At the ramp 62, the ball 42 begins to roll forward and downward along the slope of the ramp until falling therefrom, through the air along a first airborne trajectory, and impacting the tilted panel 63. In example forms, the tilted panel 63 is preferably angled (e.g., inclination angle) between about 15-45 degrees relative to a horizontal surface or the ground surface that is supporting the base 12, inward toward the chute 64. After contact with the tilted panel 63, the ball 42 bounces or ricochets therefrom along a second airborne trajectory into the opening 65 of the chute 64 (trajectory indicated by the broken lines of FIG. 7), which in turn funnels the ball 42 into the lower track 66.

By appropriate selection of features including the inclination angle of the panel 63, the elevation of the ramp 62, the slopes of the track 60 and the ramp 62, and the rotational speed of the arm 56, the ball 42 consistently bounces into the opening 65 of the chute 64 all or a substantial majority of the time. After entering the opening 65, the ball 42 is channeled into the lower track 66, which is sloped to cause the ball to roll back to the inlet at the bottom of the rotation mechanism 30, where the process can then begin again. In example forms, a sloped or angled button 70 is provided within the opening 65 to provide for generally urging the ball 42 bouncing therein to move along the lower track 66. In one example form, the angled button 70 is pivotally mounted to the base 12 and coupled to an electronic switch connected to the circuit board 26 to provide audible feedback when a ball 42 contacts the button 70 (see FIG. 2). Other example embodiments of the toy 10 may employ different methods of returning the ball 42 to the bottom portion of the rotation mechanism 30. Or, the ball 42 may remain in the basin 44 until a user manually removes it and feeds the ball into the rotation mechanism 30.

Referring back to FIG. 1, the upper track 60 is preferably sufficiently sloped downward from right to left to allow for gravity to provide for movement of the ball 42 from the basin 44, along the upper track 60, and to the ramp 62. Similarly, the lower track is preferably sufficiently sloped from left to right to allow for gravity to provide for movement of the ball 42 from within the opening 65, along the lower track 66, and to the lower portion of the rotation mechanism 30. Alternatively, drive mechanisms can be provided to move the ball 42 along one or more portions of its circuit or travel path.

In example embodiments, the toy 10 may be generally jungle themed or constructed to resemble an aquatic or other environment attractive for infants or children. For example, the rotation mechanism 30 is formed to resemble a tree, the drive shaft 34 is formed to resemble a tree trunk, the basin 44 is formed to resemble a tree's branches/leaves, the guide track 32 is formed to resemble vines, the upper track 60 is formed to resemble lush vegetation, the chute 64 is formed to resemble an animal (e.g., hippopotamus), the opening 65 is formed to resemble an animal's mouth, and the lower track 66 is formed to resemble a stream of water. In example embodiments, the components of the toy 10 are preferably injection molded from a plastic material. Optionally, other manufacturing techniques and materials may be chosen as desired. Preferably, the balls 42 are also plastic injection molded or blow molded.

While the invention has been described with reference to preferred and example embodiments, it will be understood by those skilled in the art that a variety of modifications, additions and deletions are within the scope of the invention, as defined by the following claims.

What is claimed is:

1. A toy comprising:

a base;

a vertical transport mechanism comprising a rotationally driven drive shaft extending generally vertically upward from the base and comprising a plurality of transverse paddles extending generally vertically and parallel to one another along the drive shaft, a helical guide track comprising a lower end and an upper end and extending generally coaxially around the drive shaft and the plurality of transverse paddles, and an upper receiver atop the drive shaft and comprising an opening adjacent the upper end of the guide track;

an upper track comprising a first end and a second end, the first end in communication with the upper receiver of the vertical transport mechanism and the second end comprising a downwardly inclined discharge ramp portion;

a tilted bouncing panel positioned a distance vertically below the downwardly inclined discharge ramp portion of the upper track;

a chute comprising an opening facing the tilted panel and an exit;

a lower track extending from a first end to a second end, the first end in communication with the exit of the chute and the second end in communication with a lower inlet portion of the vertical transport mechanism; and a predetermined path comprising a starting point at the lower inlet portion of the vertical transport mechanism, continuing upward along the helical guide track to the upper end of the helical guide track, through the opening of the upper receiver and continuing onto the upper receiver, from the upper receiver to the first end of the upper track and continuing to the second end of the upper track, along a first airborne trajectory between the downwardly inclined discharge ramp portion of the upper track and the tilted bouncing panel, onto the tilted bouncing panel and continuing along a second airborne trajectory between the tilted bouncing panel and the opening of the chute, through the chute and out from the exit of the chute, continuing on to the first end of the lower track, along the lower track to the second end of the lower track, and continuing back to the starting point at the lower inlet portion of the vertical transport mechanism, wherein at least one rolling object is movable along the predetermined path from the lower inlet portion of the vertical transport mechanism, upward along the helical guide track and around the drive shaft by engagement of the at least one rolling object between one of the plurality of transverse paddles and the helical guide track as the drive shaft rotates, propelling the rolling object upward along the helical guide track, to the upper end of the helical guide track, through the opening of the upper receiver and into the upper receiver, from the upper receiver to the first end of the upper track, to the second end of the upper track and dropping downwardly along the first airborne trajectory wherein the rolling object is not in contact with other objects between the downwardly inclined discharge ramp portion of the upper track and the tilted bouncing panel, into contact with the tilted bouncing panel, and bouncing off of the tilted bouncing panel and traveling along the second airborne trajectory and into the opening of the chute, through the chute and out from the exit of the chute to the first end of the lower track, along the lower track to the second end of the lower track, and back to the lower inlet portion of the vertical transport mechanism.

2. The toy of claim 1, wherein the base further comprises a motor for driving the drive shaft, a battery supply, and a circuit board.

3. The toy of claim 2, further comprising a speaker for emitting audible sounds.

4. The toy of claim 1, further comprising a spring biased trap door movably mounted to the upper receiver.

5. The toy of claim 1, wherein the tilted bouncing panel comprises an inclination angle of between about 15-45 degrees.

6. The toy of claim 1, wherein the upper track is generally downwardly sloped from the upper receiver to the downwardly inclined discharge ramp portions, and wherein the lower track is generally downwardly sloped from the chute to the lower inlet portion of the vertical transport mechanism.

7. The toy of claim 1, wherein the object that is capable of moving along the predetermined path is a ball.

8. The toy of claim 7, wherein the ball is about 1.97 inches in diameter.

9. The toy of claim 7, wherein the plurality of transverse paddles comprise at least one spacer tab for preventing two or more balls from being captured between the transverse paddles.

10. A toy comprising:

a base;

a rotation mechanism extending generally vertically upward from the base, the rotation mechanism having a first end and a second end and formed to resemble a tree and comprising a rotatable drive shaft, a helical guide track spiraling around the drive shaft, and a basin positioned atop the drive shaft, the basin having an opening and a spring-biased shutter movably mounted to the basin that selectively opens and closes the basin opening, the drive shaft being positioned generally vertically upright relative to the base and comprising at least one transverse paddle that extends parallel with the generally vertically upright drive shaft, a portion of the drive shaft extending through the basin and comprising an arm transversely extending therefrom;

an upper track formed to resemble lush vegetation and comprising a first end and a second end, the first end coupled to a portion of the basin and a second end comprising a downwardly inclined ramp;

a tilted panel positioned on a portion of the base generally vertically below the downwardly inclined ramp of the upper track;

a chute formed to resemble an animal and comprising an opening directed toward the tilted panel;

and a lower track formed to resemble a stream and extending from the chute to a lower base portion of the rotation mechanism, wherein at least one rolling object is capable of moving along a predetermined path from the lower base portion of the rotation mechanism, along the guide track and around the drive shaft by the at least one paddle engaging the rolling object and pushing the rolling object along an upward, helical path along the guide track, from the guide track up to the shutter that is actuated open by the rolling object when the rolling object is at the second end of the rotation mechanism, through the basin opening and within the basin, from the basin along the upper track and off of the downwardly inclined ramp, through a first airborne trajectory not in contact with any other objects, into contact with the tilted panel, bouncing off of the tilted panel, through a second airborne trajectory into the opening of the chute, and from the chute along the lower track back to the lower base portion of the rotation mechanism.

11. The toy of claim 10, wherein the drive shaft is formed to resemble a tree trunk, the basin is formed to resemble the tree's branches/leaves, and the guide track is formed to resemble vines.

12. The toy of claim 10, wherein the base further comprises a motor for driving the drive shaft, a battery supply, and a circuit board.

13. The toy of claim 12, further comprising a speaker for emitting audible sounds.

14. The toy of claim 10, wherein the tilted panel comprises an inclination angle between about 15-45 degrees.

15. The toy of claim 10, wherein the object that is capable of moving along the predetermined path is a ball.

16. The toy of claim 15, wherein the ball is about 1.97 inches in diameter.

17. The toy of claim 15, further comprising at least one spacer tab affixed to a portion of one or more of the transverse paddles for preventing two or more balls from being captured between two of the transverse paddles.

18. A toy comprising:

a ball;

a rotation mechanism comprising a flanged shaft and a helical track extending around and generally coaxial with the flanged shaft, wherein the flanged shaft comprises a rotationally driven drive shaft and a plurality of transverse flanges extending generally parallel to the drive shaft, wherein the helical track is independent of and spaced a distance outwardly from the flanged shaft, wherein relative rotational motion between the flanged shaft and the helical track raises the ball from a lower inlet of the rotation mechanism to an upper outlet of the rotation mechanism when the ball is engaged between the flanged shaft and the helical track and the flanged shaft is rotated;

an upper track for rolling the ball downwardly along a slope from the upper outlet of the rotation mechanism to a ramp from which the ball falls downwardly, through the air and out of contact with the ramp, along a first airborne trajectory;

an inclined contact surface generally below the ramp along the first airborne trajectory, which the ball impacts and bounces from, through the air and out of contact with the inclined contact surface, along a second airborne trajectory into a chute substantially every time the ball bounces from the inclined contact surface; and a lower track for rolling the ball from the chute to the lower inlet of the rotation mechanism.

19. A rotation mechanism for a toy, to move a ball from a first position to a second position, the rotation mechanism comprising:

an inlet proximal the first position, the inlet configured to receive a ball from a first location external of the rotation mechanism and permit passage therethrough into the rotation mechanism;

an outlet proximal the second position, the outlet configured to pass the ball therethrough out of the rotation mechanism and deliver the ball to a second location external of the rotation mechanism, wherein the outlet comprises a spring-biased shutter movably mounted to the outlet that selectively opens and closes the outlet;

an open helical guide track extending between a first end proximal the inlet of the rotation mechanism and a second end proximal the outlet of the rotation mechanism; and a vertical actuator independent of and spaced a distance from the helical guide track, the vertical actuator comprising a drive shaft and at least two flanges extending in an axial direction parallel with the drive shaft for engaging the ball between the vertical actuator and the helical guide track and propelling the ball along an upward, helical path on the guide track and around the drive shaft between the first end and the second end, the actuator being generally coaxially aligned within the helical guide track, wherein when the ball reaches the second position, the shutter is actuated open and the actuator propels the ball out of the rotation mechanism, through the outlet, and into the second location.

20. A the rotation mechanism of claim 19, further comprising a ball-drop feature having a ball discharge that receives the ball from the outlet of the rotation mechanism, and a ball receiver that directs the ball to the inlet of the rotation mechanism.

21. The rotation mechanism of claim 20, wherein the ball-drop feature further comprises a ball-bounce between the ball discharge and the ball receiver, wherein the ball-bounce comprises a tilted panel positioned vertically below the ball discharge, a chute comprising an opening facing the tilted panel and a funnel for directing the ball to the ball receiver, wherein when the ball reaches the ball-drop feature, the ball drops through the air from the ball discharge, contacts the tilted panel and ricochets therefrom into the air and into the chute, through the funnel and to the ball receiver where the ball is directed to the inlet of the rotation mechanism.

22. The rotation mechanism of claim 19, wherein the inlet is at a lower elevation than the outlet.

* * * * *